US007373970B1

(12) United States Patent
Wintill et al.

(10) Patent No.: US 7,373,970 B1
(45) Date of Patent: May 20, 2008

(54) PIN CONNECTOR WITH SEAL ASSEMBLY

(75) Inventors: Charles David Wintill, Houston, TX (US); Rodney Wayne Long, Cypress, TX (US); William Ryle Darnell, St. Martinville, LA (US); William John Darnell, Houston, TX (US); Michael Chad Darby, Katy, TX (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 11/766,098

(22) Filed: Jun. 20, 2007

(51) Int. Cl.
*E21B 44/00* (2006.01)
*H01R 4/60* (2006.01)

(52) U.S. Cl. ..... 166/65.1; 166/324; 166/334.4; 439/191

(58) Field of Classification Search ..... None
See application file for complete search history.

(56) References Cited

U.S. PATENT DOCUMENTS 5,927,402 A * 7/1999 Benson et al. ..... 166/65.1
5,967,816 A * 10/1999 Sampa et al. ..... 439/190
6,983,796 B2 1/2006 Bayne et al.

* cited by examiner

*Primary Examiner*—Frank Tsay
(74) *Attorney, Agent, or Firm*—Buskup Law Group, P.C.; Wendy Buskop

(57) ABSTRACT

A pin connector with a seal assembly using a unique wet connect assembly. The pin connector is formed from a tubular having an upper tubular portion and a lower tubular portion. The lower tubular portion has an upper tubular body and a lower tubular body with a lower tubular body face. A first pin engages the wet connect assembly. The first pin has a first pin outer surface, which can be connected to the wet connect assembly.

20 Claims, 5 Drawing Sheets

PIN CONNECTOR WITH SEAL ASSEMBLY

FIELD

The present embodiments relate generally to pin connector with a seal assembly that can be used in downhole well.

BACKGROUND

A need exists for an intelligent completion system for use inside a multi-zone hydrocarbon well.

There further exists a need for a pin connector with seal assembly that can be pulled after use, taken apart, cleaned, and reused.

The present embodiments meet these needs.

BRIEF DESCRIPTION OF THE DRAWINGS

The detailed description will be better understood in conjunction with the accompanying drawings as follows.

Figure 1:
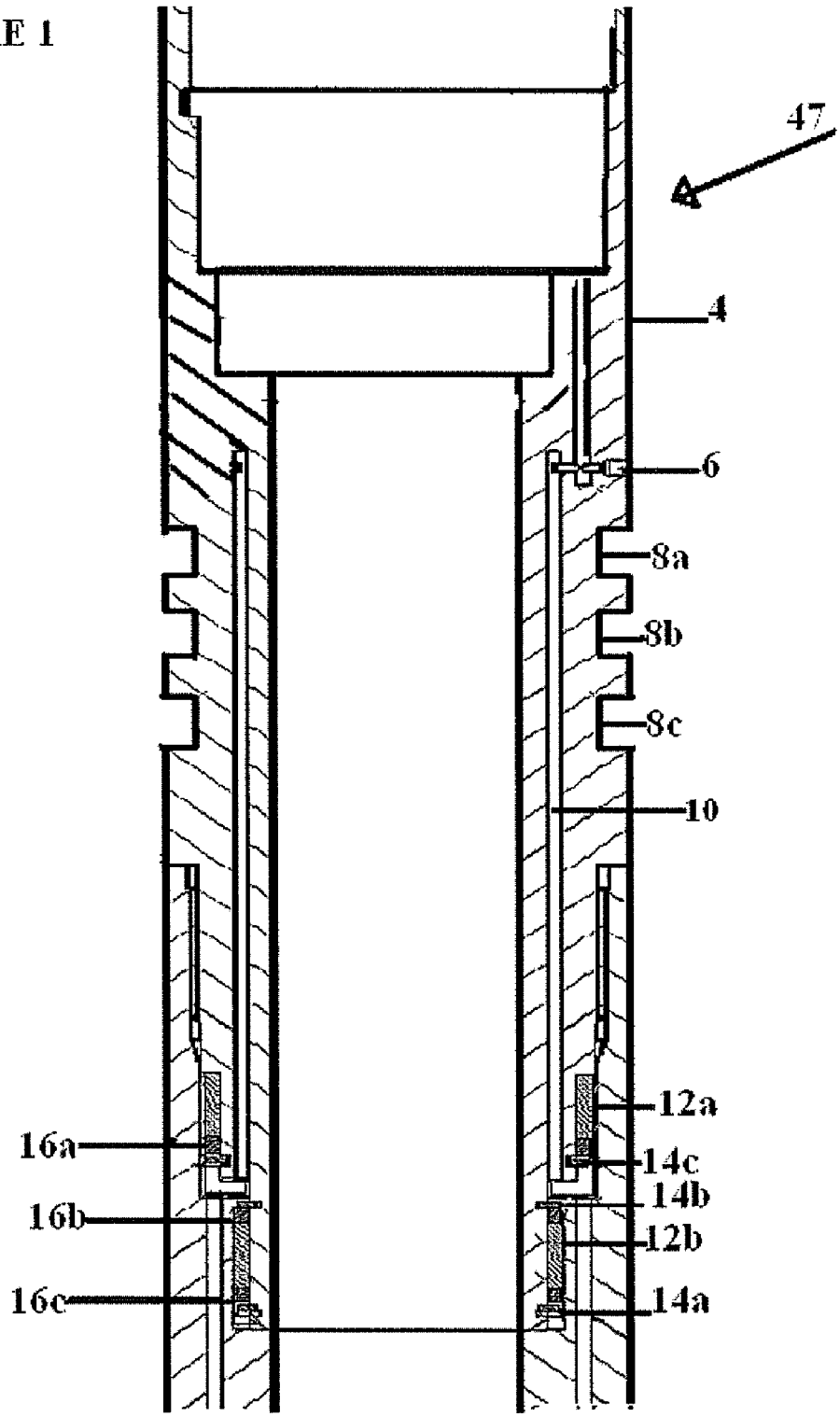
FIG. 1 depicts a cross sectional view of an embodiment of a seal assembly usable with a pin connector with seal assembly.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The embodiments of the invention relate generally to a pin connector with a seal assembly using a unique wet connect assembly. The pin connector is formed from a tubular having an upper tubular portion and a lower tubular portion.

The lower tubular portion has an upper tubular body and a lower tubular body with a lower tubular body face.

A first pin engages the wet connect assembly. The first pin has a first pin outer surface, which can be connected to the wet connect assembly.

In a second embodiment a double pin is in the lower tubular portion. The double pin engages the wet connect assembly. In the double pin embodiment, a second pin concentrically surrounds the first pin forming a double pin connector. The double pin connector is particularly useful in packers such as those adapted for multi zone gravel packing in hydrocarbon wells.

In either the single pin or double pin version of the pin connector with seal assembly, a control line connector, such as a jam nut, is used on the first pin outer surface and the lower tubular body face.

At least one alignment key is formed in at least a part of the tubular body. The alignment key can be disposed on an inner diameter of the tubular body and can extend from a top portion of the lower tubular body toward a mid section of the lower tubular body. The alignment key, in an embodiment, is formed at an angle from the top, sloping in a curve, such as a sine curve along the lower tubular body. The alignment key extends no more than 10% the length of the lower tubular body.

In an alternative embodiment of the pin connector with seal assembly, the at least one alignment key can be disposed on an interior wall of the tubular body portion. Multiple alignment keys can be used on one tubular body portion for a secure locking engagement.

The lower tubular body has a lower hydraulic flow path formed within the lower tubular body for flowing controlled hydraulic fluids. This lower hydraulic flow path communicates on one end with a hydraulic wet connector.

Additionally, a two part locking mechanism can be used to connect the upper tubular portion to the lower tubular portion In an embodiment, one part of the locking mechanism has a collar. The collar can be threaded or force fit to the second part of the locking mechanism. Additionally, a lower tubular seal can be disposed between the collar and the lower tubular portion to ensure a snug, leak-tight fit.

The two part locking mechanism can be used to secure the upper tubular portion or the seal assembly to another piece of well equipment.

The second part of the locking mechanism is a locking key. The locking key is engaged by a shear pin. The shear pin further engages a lower key retainer. The locking key is also engaged using a upper key retainer. The upper key retainer engages the upper tubular portion. The upper portion of the locking mechanism has at least one fastener, such as a screw, to secure the upper portion of the locking mechanism. A force is exerted on the upper tubular portion and the locking key by a mechanism, such as a coiled spring, a wave spring, or similar force applying mechanism.

The upper tubular portion is removably connected to the lower tubular portion, such as with force fit connection or stabbed in connection. It is also contemplated that the upper tubular portion can be stabbed into the lower tubular portion for a secure connection, such as a body lock ring.

The upper tubular portion has a receiving hydraulic wet connector, which removably engages the extending hydraulic wet connector of the lower tubular portion.

In an embodiment, the receiving hydraulic wet connector is a quick release hydraulic wet connector, which is particularly useful in an emergency, such as when there is an excessive pressure build up and there is a need for a fast release.

An intermediate hydraulic flow path is also formed in the upper tubular body. The intermediate hydraulic flow path fluidly engages the lower hydraulic flow path.

At least one alignment groove is formed on the upper tubular body. The alignment groove is for receiving at least one alignment key. At least one alignment key is formed in the upper tubular body, and an alignment groove is formed in the lower tubular portion for receiving the at least one alignment key.

In the present embodiment of the pin connector with seal assembly, the upper tubular portion removably engages a seal assembly. The seal assembly can include a tubular seal assembly body. In the tubular seal assembly an upper hydraulic flow path can be formed which fluidly engages the intermediate hydraulic flow path.

Between the tubular seal assembly body and the upper tubular body there can be a plurality of upper hydraulic flow path seals. The hydraulic flow path seals are contemplated to be non-elastomeric, such as metal to metal seals. The hydraulic flow path seals can have different diameters from each other. In another embodiment, the hydraulic flow path seals are all the same diameter.

A plurality of upper concentric seals can be positioned, such that they form a sealing engagement around the upper hydraulic flow path seals. A sealing engagement can be formed in the upper hydraulic flow path by using a plurality of seal assembly fasteners to apply a force to the upper hydraulic flow path seals. An example of a seal assembly fastener is a snap ring. The seal assembly fasteners can be made from any alloy steel readily available from Smalley Spring Company, Chicago, Ill.

In an embodiment at least one seal ring can be used for supporting, such as rigidly supporting, at least one upper hydraulic flow path seal. The seal ring can be made from a plastic or alloy steel.

A hydraulic flow path plug can be used to provide a sealing engagement with the upper hydraulic flow path and the tubular seal assembly body. The plug can have a diameter of between 0.032 inches and 0.500, and a length of between 0.125 and 0.562.

The pin connector with seal assembly can be used within a packer to form an integrated wet connect assembly. The integrated wet connect assembly preferably engages a valve and production tubing on one end and another seal assembly on the other end of the integrated wet connect assembly.

The embodiments of the pin connector with seal assembly reduce installation time and the costs associated with downhole hydrocarbon production.

An embodiment of the pin connector with seal assembly provides a downhole well equipment that is more efficient because there is no field assembly required.

An embodiment of the pin connector with seal assembly can be assembled at a remote location, and can be ready for immediate use upon reaching the field.

An embodiment of the pin connector with seal assembly is a well containment feature because the downhole assembly is stung in or engaging the well. Thereby, isolating the well and preventing well bore fluid from leaking into the annulus above the packer, preventing a well control situation. The seal assembly prevents fluid from leaking into the environment and contaminating water tables.

The embodiments of the invention can be best understood with reference to the figures.

Referring now to FIG. 1, which depicts an embodiment of a seal assembly 47. The seal assembly 47 includes a tubular seal assembly body 4, a hydraulic flow path plug 6, an upper hydraulic flow path 10 formed in the tubular seal assembly body 4, a first seal ring 16*a*, a second seal ring 16*b*, and a third seal ring 16*c*, a first upper hydraulic flow path seal 12*a*, a second hydraulic flow path seal 12*b*, a first seal assembly fastener 14*a*, a second seal assembly fastener 14*b*, a third seal assembly fastener 14*c*, a first upper concentric seal 8*a*, a second upper concentric seal 8*b*, and a third upper concentric seal 8*c*.

The tubular seal assembly body 4 can be made from alloy steel, and can have a length ranging from 10 inches to 36 inches, a diameter ranging from 2.688 inches to 6 inches. The seal assembly body 4 is depicted having the hydraulic flow path plug 6, such as a lee plug from Lee Company in Connecticut. The hydraulic flow path plug 6 provides a seal for the upper hydraulic flow path 10.

The hydraulic flow path can have a volumetric flow rate equivalent to the capacity of a 0.25 inch control line. The hydraulic flow path can be formed into the tubular seal assembly by inserting a hydraulic line with a diameter ranging from 0.25 inches to 0.5 inches.

The first seal ring 16*a* can support a first hydraulic flow path seal 12*a* and be made from an alloy steel or non elastomeric material, such as a rigid polyethylene seal ring or rigid polyethylene/polypropylene copolymers.

The second seal ring 16*b* can support the second hydraulic flow path seal 12*b*. The first seal ring 16*a* and the second seal ring 16*b* provide support to the hydraulic flow path seals 12*a* and 12*b*.

The first hydraulic flow path seal 12*a* and the second hydraulic flow path seal 12*b* can be similar to each other or in the alternative the first and second hydraulic flow path seals 12*a* and 12*b* can be different. The first and second hydraulic flow path seals 12*a* and 12*b* can have a diameter ranging from 1.9 inches to 6.75 inches. The flow path seals can be made from non elastomeric materials, such as polymer plastics, including poly ethyl ketone (PEEK), or other materials.

The first seal ring 16*a*, the second seal ring 16*b*, and the third seal ring 16*c* can be similar in design or in the alternative each seal ring can be made from a different material. The diameters of each seal ring can be similar or different.

The first seal assembly fastener 14*a* can be a threaded cap. The second seal assembly fastener 14*b*, which can be similar to the first seal assembly fastener 14*a*. The fasteners are adapted to retain the second upper hydraulic flow path seal 2*b*.

The third seal assembly fastener 14*c*, which can be similar to the second seal assembly fastener 14*ab*, which can be similar to the first seal assembly 14*a*.

It is possible to have an embodiment wherein the first seal assembly fastener, the second seal ring fastener, the third seal ring fastener can be made from steel.

The first, second and third concentric seals 8*a*, 8*b*, and 8*c* can be an elastomeric or non-elastomeric seal. Greene Tweed from Houston Tex. supplies usable concentric seals for this embodiment. The first concentric seal 8*a*, the second concentric seal 8*b*, and the third concentric seal 8*c* can be similar to each other.

Figure 2:
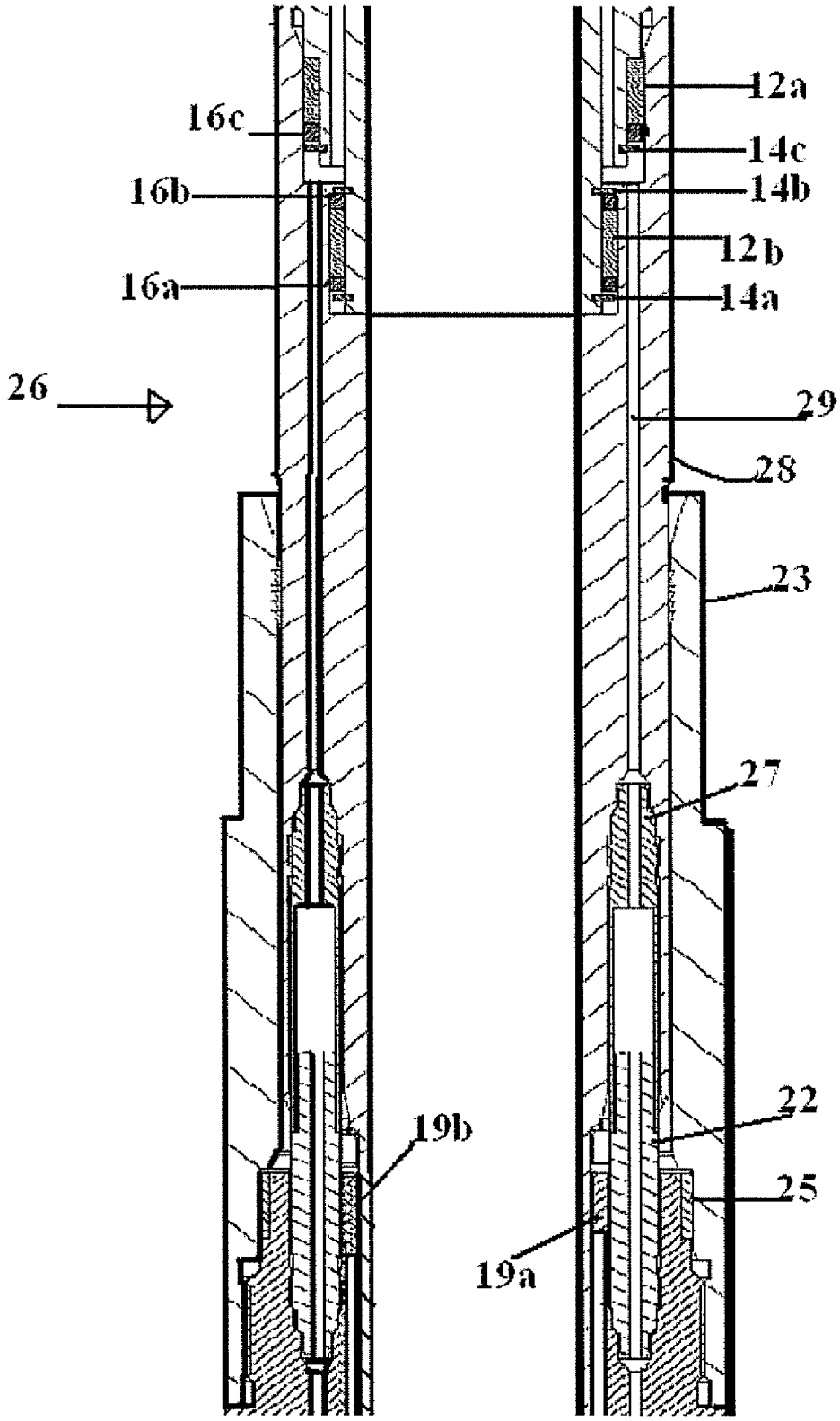
FIG. 2 depicts a cross sectional view of an embodiment of a upper tubular portion for an embodiment of the pin connector with seal assembly.

Turning now to FIG. 2 the upper tubular portion 26 is depicted. The upper tubular portion 26 has an upper tubular body 28 that removably engages the seal assembly 47. The seal assembly 47 is best depicted in FIG. 1. The upper tubular body 28 can be made from alloy steel, and have a length ranging from 2 feet to 6 feet.

Returning to FIG. 2, the upper tubular portion 26 is depicted having an intermediate hydraulic flow path 29. The intermediate hydraulic flow path can have an inner diameter from 0.125 inches to 0.5 inches. In the alternative embodiment, the intermediate hydraulic flow path can be a machined port. The intermediate hydraulic flow path 29 is in fluid communication with the upper hydraulic flow path 10. The upper hydraulic flow path 10 is depicted in FIG. 1.

The intermediate hydraulic flow path 29 and the upper hydraulic flow path 10 are coupled together, for example using the seals.

Figure 3:
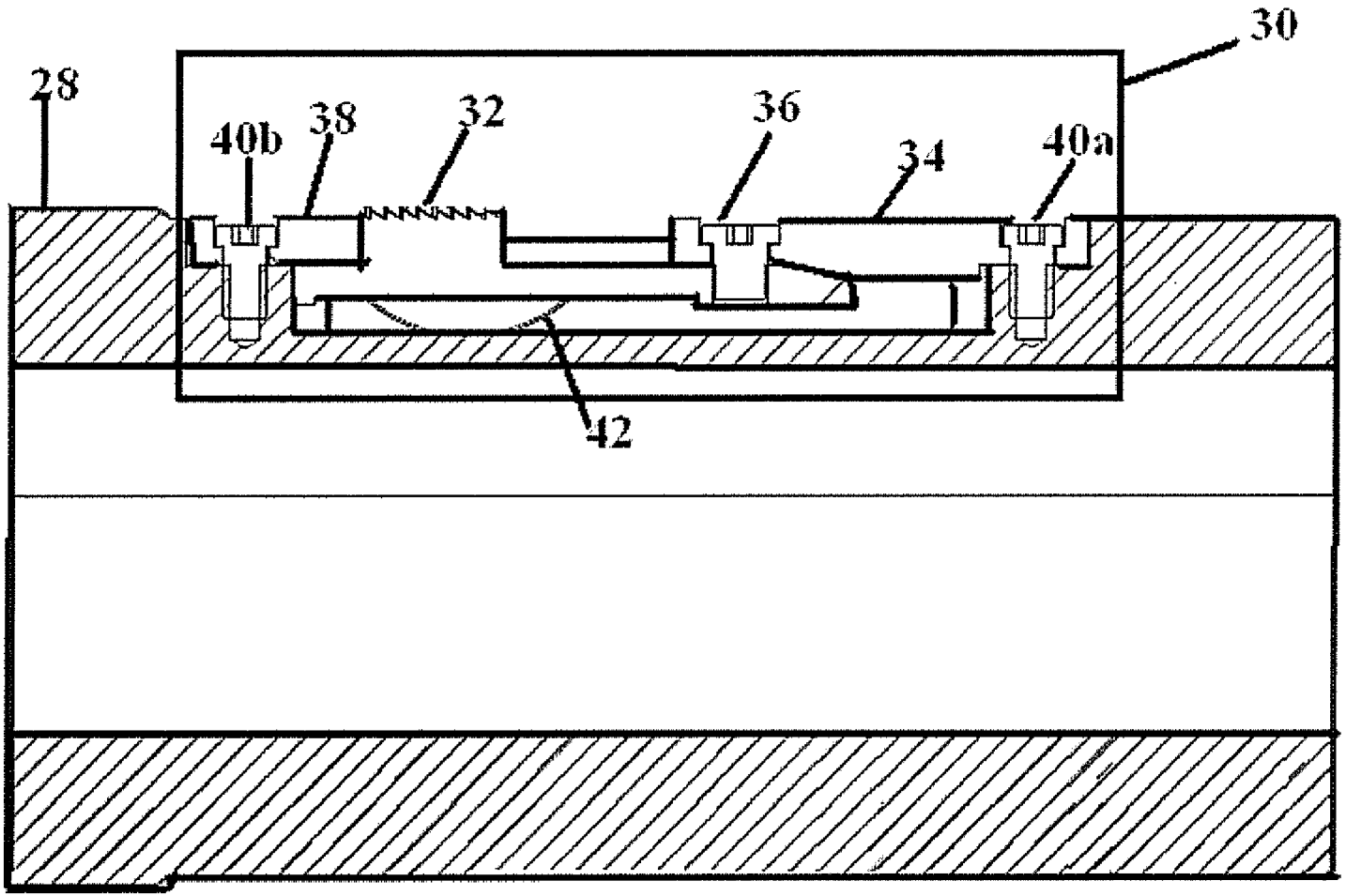
FIG. 3 depicts an detailed cross sectional view of a locking mechanism for use with the pin connector with seal assembly.

Referring now to FIG. 3, the upper tubular portion 26 is connected to an upper portion 30 of a locking mechanism 24. The upper portion 30 is depicted having a shear pin 36, such as a brass or annealed steel shear pin, such as those available from Shamrock Fasteners of greater Houston, Tex.

A locking key 32 is machined as part of the overall pin and seal assembly in to the upper tubular of the lower tubular portion or both. The locking key is a combination of grooves and projections that interlock together.

A lower key retainer 34 is a machined part used for holding the locking key in either the locked or unlocked position. In an embodiment, the lower key retainer can be a circular part with a diameter larger than the annulus of the bore of the tool. The retainer can be a segment, such as a "D" shape or an open "D" shape.

An upper key retainer 38 can be similar to the lower key retainer. In an embodiment, the upper key retainer can be a circular part with a diameter larger than the annulus of the bore of the tool. The upper key retainer can be a segment, such as a "D" shape or an open "D" shape.

The mechanism for providing force 42 can be a coiled spring, a wave spring, or a similar force providing mechanism. If a coiled spring is used, it can be one provided by Suhm of Houston, Tex.

The shear pin 36 engages the locking key 32 and the lower key retainer 34. The shear pin 36 can be a solid cylinder with a centrally aligned through hole. The shear pin 36 can be made from steel, stainless steel, or similar materials.

The upper key retainer 38 can have a channel, with a depth ranging from 0.5 inches to 1 inches adapted for receiving the locking key 32.

The upper portion 30 is secured to upper tubular portion 26 by the first fastener 40*a* and the second fastener 40*b*. The first fastener 40*a* and the second fastener 40*b* can be planarly aligned with each other. It is possible to use more than two fasteners to secure the upper locking mechanism to the upper tubular portion 26.

The mechanism for exerting force 42 interacts with the locking key 32 and the upper tubular portion 26.

The interaction of the mechanism for exerting force 42 with the locking key 32 and the upper tubular portion 26 provides the benefit of providing retraction in and out, an axial force when the lower tubular portion is driven into the well, in a ratcheting unidirectional motion.

Returning to FIG. 2, a fastener 23 can be located on the upper tubular portion of the pin and seal assembly, for securing to a piece of well equipment, wherein the piece of well equipment can be a packer, or another type of well equipment.

The fastener 23 can be a collar for engaging the upper portion 30 and anchoring the upper tubular portion to another piece of well equipment.

FIG. 2 further depicts a lower tubular seal 25 which is disposed between the collar 23 and the lower tubular portion 21. The lower tubular seal 25 can have a diameter ranging from 1.9 inches to 6 inches. The lower tubular seal 25 can be made from plastic, elastomeric material or a non-elastomeric material to create seals.

The upper tubular portion has a receiving hydraulic wet connector 27, for example, a Seaport wet connect made by Diamould from the United Kingdom. The receiving hydraulic wet connector 27 removably engages an extending hydraulic wet connector 22, which can also be made by Diamould. The receiving hydraulic wet connector 22 is supported by the upper tubular body 28.

The upper tubular body 28 supports the receiving hydraulic wet connector 22 by creating a threaded engagement with the receiving hydraulic wet connector 22, FIG. 2 depicts a first alignment key 19*a*, and a second alignment key 19*b*, which is similar to the first alignment key 19*a*. The alignment keys are machined parts that are at least partially disposed on the lower tubular body 21.

Although the embodiment in FIG. 2 depicts two alignment keys, it is possible to have more than two alignment keys or less than two alignment keys, as long as there is at least one alignment key. In an alternative embodiment, the alignment keys can differ from each other. In length and thickness. For example one alignment key can have a length of ¼ inch and the second alignment key can have a length of 10 inches.

Figure 4A:
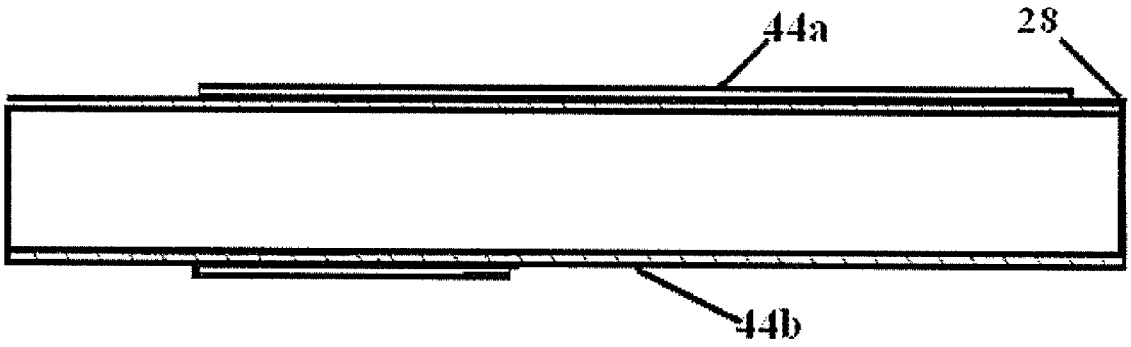
FIG. 4*a* depicts a cross sectional view of an embodiment of a upper tubular body with at least one alignment groove that is usable with the embodiments of the pin connector with seal assembly.
Figure 4B:
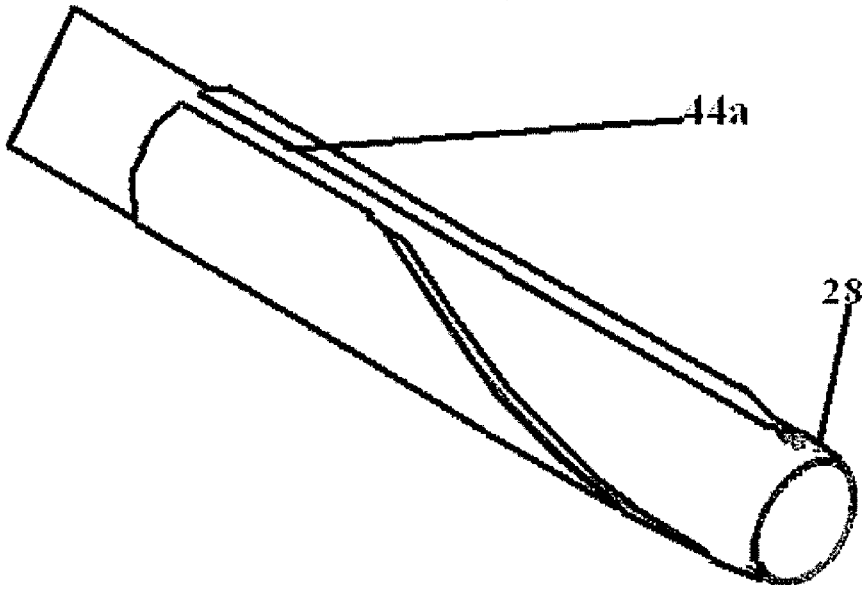
FIG. 4*b* is a perspective view of the upper tubular body with the alignment groove.

Turning now to FIGS. 4*a* and 4*b*, which depict a first alignment groove 44*a* and a second alignment groove 44*b* formed on the upper tubular body 28. The first alignment groove 44*a* receives either alignment key 19*a* and the second alignment groove 44*b* receives either alignment key. There should be at least one alignment groove.

The first alignment groove 44*a* and the second alignment groove 44*b* can have a depth ranging from 0.30 inches to 0.05 inches. The alignment grooves can be molded, machined, or forged into the upper tubular body 28.

Figure 5:
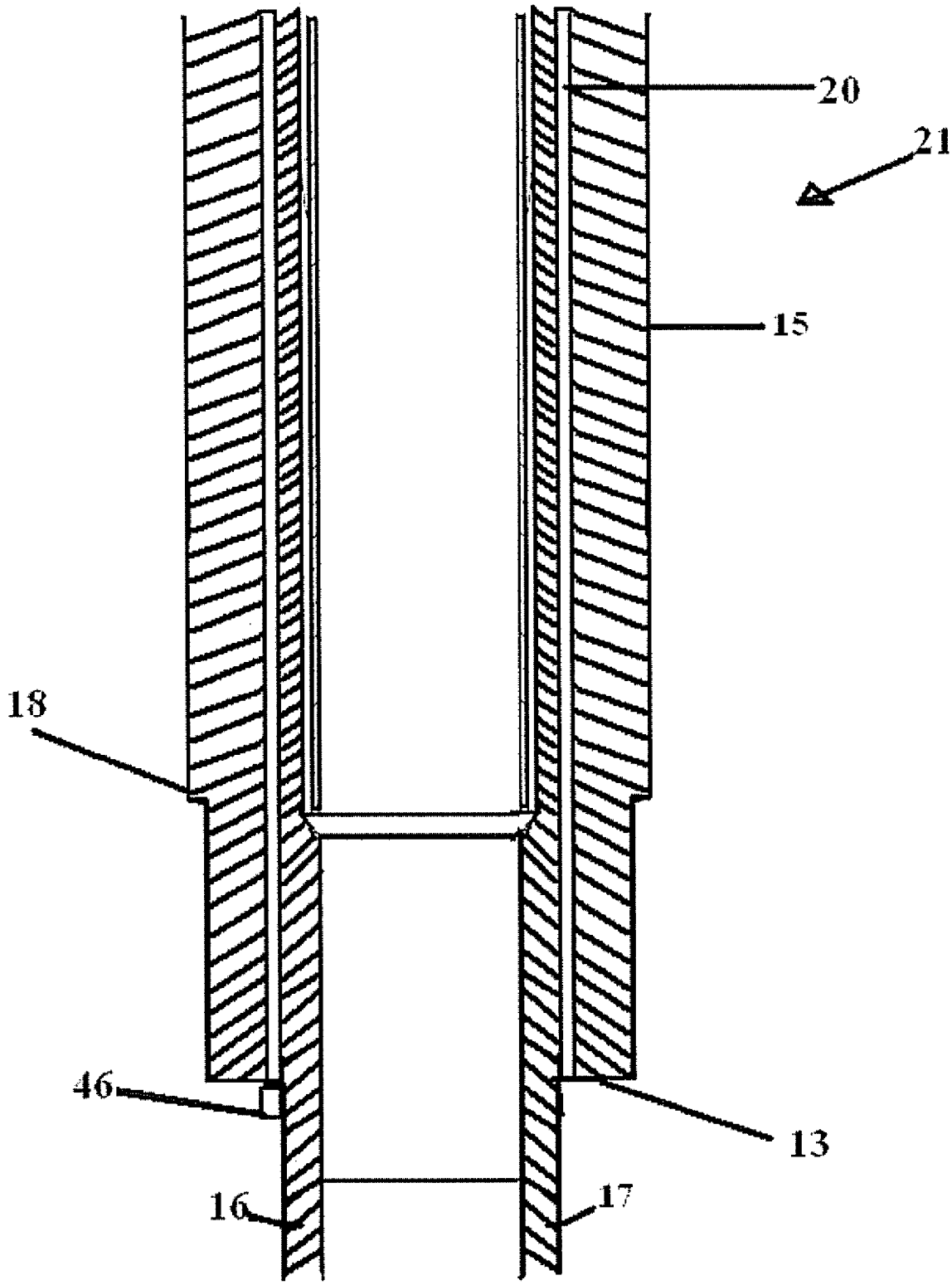
FIG. 5 depicts a cross sectional view of an embodiment of a lower tubular portion for an embodiment of the pin connector with seal assembly.

Turning now to FIG. 5, which depicts an embodiment of the lower tubular portion 21. The lower tubular portion 21 has a lower tubular body 15. The lower tubular body 15 can have a length ranging from 2 feet to 6 feet, and an outer diameter ranging from 2 inches to 15 inches.

A lower hydraulic flow path 20 is formed into the lower tubular body 15. The lower hydraulic flow path 20 fluidly engages the intermediate hydraulic flow path 29. The fluid engagement is enabled by a coupling.

The lower hydraulic flow path 20 can be a port machined into the lower tubular body 15.

In a typical embodiment of the invention each of the hydraulic flow paths have the same hydraulic fluid and the same flow rate.

The lower tubular body has a lower tubular body face 13. The lower tubular body face 13 can have a flange angle ranging from 30 degrees to 90 degrees. The lower tubular body face 13 can be made from a metal adapted to survive a highly corrosive environment.

The lower tubular portion further has a first pin 16. The pin 16 can be manufactured by Pertroquip Energy Services of Broussard, La. and Houston, Tex. The first pin 16 can have a length ranging from 3 inches to 9 inches. The first pin 16 can have a cylindrical shape and can be solid or hollow.

The first pin 16 has a first pin outer surface 17. The first pin outer surface can be a metal, a composite, or a similar material. The first pin outer surface 17 in a typical embodiment will be made form the same material of the first pin 16

In the embodiment depicted in FIG. 5, a second pin 18. The second pin 18 concentrically surrounds the first pin 16. In the embodiment in FIG. 5 a double pin connector is formed using the first and second pins. The double pin connector can be adapted for multi zone gravel packing in a hydrocarbon well. It should be noted that the two pin embodiment is not required, and that it is possible for an embodiment of the invention to have only a first pin 16.

FIG. 5 depicts a control line connector 46 disposed between the first pin outer surface 17 and the lower tubular body face 13. The control line connector 46 can be adapted to handle a fluid pressure ranging from 2,000 psi to 20,000 psi.

While these embodiments have been described with emphasis on the embodiments, it should be understood that within the scope of the appended claims, the embodiments might be practiced other than as specifically described herein.

What is claimed is:

1. A pin connector with seal assembly comprising:

a wet connect assembly, wherein the wet connect assembly comprises:

a lower tubular portion comprising:

a lower tubular body having a lower tubular body face;

a first pin having a first pin outer surface;

a lower hydraulic flow path formed in the lower tubular portion;

an extending hydraulic wet connector for at least partially engaging the lower tubular portion;

an upper tubular portion removably connected to the lower tubular portion, wherein the lower tubular portion comprises:

an upper tubular body for supporting the receiving hydraulic wet connector;

an intermediate hydraulic flow path formed in the upper tubular body fluidly engaging the lower hydraulic flow path;

a receiving hydraulic wet connector for engaging the upper tubular portion and removably engaging the extending hydraulic wet connector;

a seal assembly removably engaging the upper tubular portion, wherein the seal assembly comprises:

a tubular seal assembly body;

an upper hydraulic flow path formed in the tubular seal assembly body fluidly engaging the intermediate hydraulic flow path;

a plurality of upper concentric seals forming a sealing engagement around the upper tubular portion; and at least one fastener disposed in (i) the lower tubular potion for latching the lower tubular portion to the upper tubular portion;

(ii) the upper tubular portion for anchoring the upper tubular portion to another piece of well equipment;

(iii) the seal assembly for anchoring the seal assembly to another piece of well equipment or combinations thereof.

2. The pin connector with seal assembly of claim 1, wherein the upper tubular portion comprises an upper portion of the locking mechanism connected to the upper tubular body engaging a locking mechanism on the lower tubular body.

3. The pin connector with seal assembly of claim 1, further comprising at least one alignment key at least partially disposed on the lower tubular portion.

4. The pin connector with seal assembly of claim 3, wherein the upper tubular portion comprises at least one alignment groove formed on the upper tubular body for receiving the at least one alignment key.

5. The pin connector with seal assembly of claim 1, further comprising a plurality of upper hydraulic flow path seals between the tubular seal assembly body and the upper tubular body.

6. The pin connector with seal assembly of claim 1, wherein the at least one fastener disposed in the lower tubular portion is for anchoring the lower tubular portion to another piece of well equipment.

7. The pin connector with seal assembly of claim 2, wherein the locking mechanism on the lower tubular body is a collar.

8. The pin connector of claim 7, further comprising a lower tubular seal disposed between the collar and the lower tubular portion.

9. The pin connector with seal assembly of claim 7, wherein the collar is disposed around the lower tubular portion.

10. The pin connector with seal assembly of claim 1, further comprising a plurality of seal assembly fasteners for applying a force to the upper hydraulic flow path seals forming a sealing engagement in the upper hydraulic flow path.

11. The pin connector with seal assembly of claim 1, wherein the upper portion is threaded to the lower portion.

12. The pin connector with seal assembly of claim 1, wherein the receiving hydraulic wet connector is a quick release.

13. The pin connector with seal assembly of claim 1, wherein the hydraulic flow path seals are non-elastomeric.

14. The pin connector with seal assembly of claim 1, wherein the hydraulic flow path seals have different diameters.

15. The pin connector with seal assembly of claim 2, wherein the upper portion of the locking mechanism comprises:

a locking key;

a lower key retainer;

a shear pin for engaging the locking key and the lower key retainer;

an upper key retainer for engaging the locking key and the upper tubular portion;

at least one fastener; and a mechanism for exerting a force on the locking key and the upper tubular portion.

16. The pin connector with seal assembly of claim 3, wherein the alignment key is disposed on an inner diameter of the tubular body and extending from a top portion of the tubular body no more than 10% of the length of the tubular body.

17. The pin connector with seal assembly of claim 1, further comprising a second pin surrounding the first pin in the lower tubular portion forming a double pin connector, and wherein the double pin connector is adapted for multi zone gravel packing in a well.

18. The pin connector with seal assembly of claim 1, further comprising a control line connector disposed between the first pin outer surface and the lower tubular body face.

19. The pin connector with seal assembly of claim 1, wherein the seal assembly has a hydraulic flow path plug for providing a sealing engagement with the upper hydraulic flow path and the tubular seal assembly body.

20. The pin connector with seal assembly of claim 1, further comprising at least one seal ring for supporting at least one upper hydraulic flow path seal.

* * * * *